US009761078B1

(12) United States Patent
Schuck

(10) Patent No.: US 9,761,078 B1
(45) Date of Patent: Sep. 12, 2017

(54) VENDING MACHINE REMOTE SENSING OF CONTENTS APPARATUS

(71) Applicant: David Alan Schuck, Evansville, IN (US)

(72) Inventor: David Alan Schuck, Evansville, IN (US)

( * ) Notice: Subject to any disclaimer, the term of this patent is extended or adjusted under 35 U.S.C. 154(b) by 0 days.

(21) Appl. No.: 15/530,932

(22) Filed: Mar. 24, 2017

Related U.S. Application Data

(63) Continuation-in-part of application No. 14/999,604, filed on Jun. 1, 2016, now Pat. No. 9,652,922.

(51) Int. Cl.
*G07F 7/00* (2006.01)
*G07F 7/08* (2006.01)
*G07F 9/10* (2006.01)

(52) U.S. Cl.
CPC ..... *G07F 7/005* (2013.01); *G07F 7/0833* (2013.01); *G07F 7/0893* (2013.01); *G07F 9/10* (2013.01)

(58) Field of Classification Search
CPC ..... G07F 11/16; G07F 11/24; G07F 11/36; G07F 11/42
USPC ..... 235/381; 700/231, 232, 236, 241–244
See application file for complete search history.

(56) References Cited

U.S. PATENT DOCUMENTS 6,269,285 B1 * 7/2001 Mignault ..... A47F 1/06 206/745
2007/0199951 A1 * 8/2007 Levasseur ..... G07F 11/24 221/124
2011/0024441 A1 * 2/2011 Marin ..... G07F 11/00 221/2

* cited by examiner

*Primary Examiner* — Suezu Ellis
(74) *Attorney, Agent, or Firm* — George H. Morgan; Gary K. Price

(57) ABSTRACT

A vending machine remotes contents sensing apparatus collects information from the actual delivery of a product, sends it on to an MCU, then to a CPU, to the internet, to a remote receiver with a web interface application on a web page for access by a service person for real time delivery information.

5 Claims, 6 Drawing Sheets

© DAVID ALAN SCHUCK

© DAVID ALAN SCHUCK

VENDING MACHINE REMOTE SENSING OF CONTENTS APPARATUS

A portion of the disclosure of this disclosure for this patent document contains material to which a claim for copyright is made. This copyright owner has no objection to the facsimile reproduction of by anyone of the patent document or the patent disclosure, as it appears in the Patent and Trademark Office Patent file or records, but reserves all other copyrights whatsoever.

CROSS REFERENCES TO RELATED APPLICATIONS

This application is a continuation in part of application Ser. No. 14/999,604 filed 2016 Jun. 3 with the same title: Vending Machine Remote Sensing of Contents Apparatus.

STATEMENTS AS TO RIGHTS TO INVENTIONS MADE UNDER FEDERALLY SPONSORED RESEARCH AND DEVELOPMENT

Not applicable

BACKGROUND OF THE INVENTION

1. Field of the Invention

This invention relates to a method and apparatus for machines such as, but not restricted to, vending machines and gaming machines which allows remote assessing of contents such as, but not restricted to product usage and cash accumulation.

2. Background Information

Many vending machines for food, soft drink, and candy products, especially older vending machines, do not have any remote means for the assessment of vending machine contents such as, but not restricted to, product inventory and cash accumulations.

As much as half the trips made by a vending machine route man are trips that were would have been unnecessary had the man had approximate, real time, information on the machine contents.

Also, on newer machines, there is no real time measure of what is actually being delivered. If the machine' delivery mechanisms fail, a sale is still recorded as if the product was delivered. As a specific example, where the product movement is a helical coil, if the coil becomes loose from the coil drive motor, the internal computer registers a product delivery that did not take place.

As will be seen from the subsequent description of the preferred embodiments of the present invention, this present invention alleviates shortcomings of existing methods of assessing vending machine contents.

SUMMARY OF THE INVENTION

The preferred embodiments of the present invention is a remote assessment of vending machine contents apparatus comprising a product tray, a product delivery drive, a product delivery feed, a microcontroller unit (MCU), a central processing unit (CPU), and at least one switch. Products are stocked in the product delivery feed. In a first embodiment when a customer purchases a product, the product delivery drive rotates the product delivery feed, which delivers the purchased product and also rotates a product movement facilitator attached to the product delivery feed. A magnet is mounted on the product movement facility which is rotated past said at least one switch which is mounted on the product tray contained in the vending machine. The magnet triggers the switch into a passing mode which permits an electrical signal that a product a product being delivered. The magnet is mounted on a product movement facilitator. The product movement facilitator is rotated by a product delivery drive of the vending machine when a product is purchased. The movement of the magnet past the switch mounted on the product tray activates the switch, permitting transmission of information of product delivery to the MCU which receives the information that a product was delivered from a specific product delivery feed in the vending machine and transforms the information into a usable format to the CPU. This information can be accessed by a laptop computer. Also the usable format of the information can be sent on to the internet where it is accessible by a service person from a remote receiver with a web page that has a program which is known in the trade as a web interface application program. The remote receiver such as, but not restricted to a computer, laptop, I PHONE™, or smart phone with the web page enabled with the web interface application program, calculates information such as, but not restricted to, accumulated sales, and inventory remaining in given product delivery feed into a readable format which enables a service person to access the information program. Other information, such as cash accumulations, can also be handled by the remote receiver, when appropriate apparatuses are included in the information process, as mentioned above.

If the internet is not working, the CPU stores the information in the usable format until the internet is working.

When a coin collection sensing apparatus or a money bill collection sensing apparatus is used, information on cash collected can also be sent to and through the MCU, to and through the CPU, to and through the internet to the remote receiver with a web page enabled with the web interface application program. The remote receiver with the web interface application program provides information, in a readable form for access by a service person, such as, but not restricted to, how much cash has been collected, enabling the service person to judge when to pick up the cash. The information provided to the In a second embodiment, there is an radio frequency identification (RFID tag. The RFID tag either came with the product or is attached to the product movement facilitator. If the product did not come with the RFID tag, a tilt switch and a modified RFID tag are mounted on the product movement facilitator replacing the aforementioned magnet and switch. The modified RFID tag is an RFID tag wherein the internal circuit was clipped, so as to leave a gap in the internal circuit. Upon delivery of one of the products contained in a given product delivery feed in the vending machine, the movement facilitator is rotated by the product delivery drive, a tilt switch on the product delivery feed is tilted. The tilt switch, in the preferred embodiment is a tilt switch with an internal ball and two wires protruding. One is attached to one side of said gap, the other wire to the other side of the gap. When the tilt switch is tilted the gap is closed so the modified RFID tag can be energized and information on the modified RFID tag can be collected by an RFID antenna which is connected to an RFID tag reader. The modified RFID tag information is read by the RFID tag reader. The RFID tag information read off the modified RFID tag is then routed directly to the CPU which sends the RFID tag information to the internet which it is then accessible on the web page with the web interface application program by the service person with a remote receiver. The web page with the web interface application program processes the information to a readable form and saves the readable information for remote access by the service person. If the internet is not accessible at that time, the CPU stores the information until the internet is accessible. The remote receiver with the web page with the web interface application program gives information in a readable form such as, but not restricted to, the cumulative sales and the remaining inventory in the given product delivery feed, which can be read by a service person. This information as read by the service person is real time information on actual product delivery.

The RFID tag, when used with the tilt switch is modified by breaking the internal circuit by clipping the wire in the RFID tag so as to break the circuit. The tilt switch has two wires, wherein each wire is connected to the RFID tag circuit, one on each side of the circuit break. Then the tilt switch is rotated, a ball, in the case of a mechanical tilt switch, closes the circuit, and the RFID can then be read. This modification is known in the trade as it is published on the internet, which is where applicant found it.

If the product has an RFID tag, as opposed to an RFID attached to the product movement facilitator, there is need neither for a switch or a modification to the MD tag. The RFID tag of a product at time of delivery is read directly by the RFID tag reader attached to the aforementioned RFID antenna and the RFID tag reader sends the RFID information directly to the CPU which sends it on to the internet where it is accessible on the remote receiver with the aforementioned web page with a web interface application program in a readable form by a service person.

An example of a coin collector apparatus is a coin collector comprising a coin weight sensor, a light sensor, a coin track, and a coin collection container. The light sensor counts coins as they fall through the coin track. The weight sensor weighs the total coins collected in the coin weight sensor. The number of coins and the weight information, if both sensors are used, is transmitted to the MCU which transforms the information received by the MCU into a usable format and passes this information in a usable format to the CPU for transmission to the internet from where it is available on the web page with the web interface application program on the remote receiver in a readable form to a service person.

This information gives at least an approximate value of the coins collected which is adequate for the purpose intended (i.e. informing a service person of approximate value of cash in the machine).

An example of a money bill collecting apparatus is a money bill collector comprising a c bill reception slot, a channel, a storage area, a floating plate, at least one spring and a proximity sensor. A money bill is inserted into the slot, through the channel, and into the storage area. The floating plate is spring biased against the bills as they accumulate. The proximity light sensor counts each bill and also gives a reading of what is the percentage of bill storage capacity has been used. This information is passed on to the MCU which manipulates the information received into a usable format, which the MCU passes on to the CPU which sends the information in the usable format to the internet. If the internet is not working, the CPU stores the information in the usable format for transmission to the internet when the internet is working. From the internet the information in a usable format on a web page with a web interface application program on a remote receiver. The web page with the web interface application takes the information in the usable format and translates that usable format into readable information, such as, but not restricted to, the approximate value of bills collected, number of bills collected in the storage area, and percent of storage area fill, and capacity remaining in the storage area for more bill deposits. Said information can be read by a service person to assist in judging when it is time to remove the bills from the storage are. The approximate value of the bills collected is computed by based on past history of the bill's denomination mix.

In the above discussions that mention the internet, access can be by an ISP router or DSL or equivalent.

DESCRIPTION OF THE PREFERRED EMBODIMENTS

Figure 1:
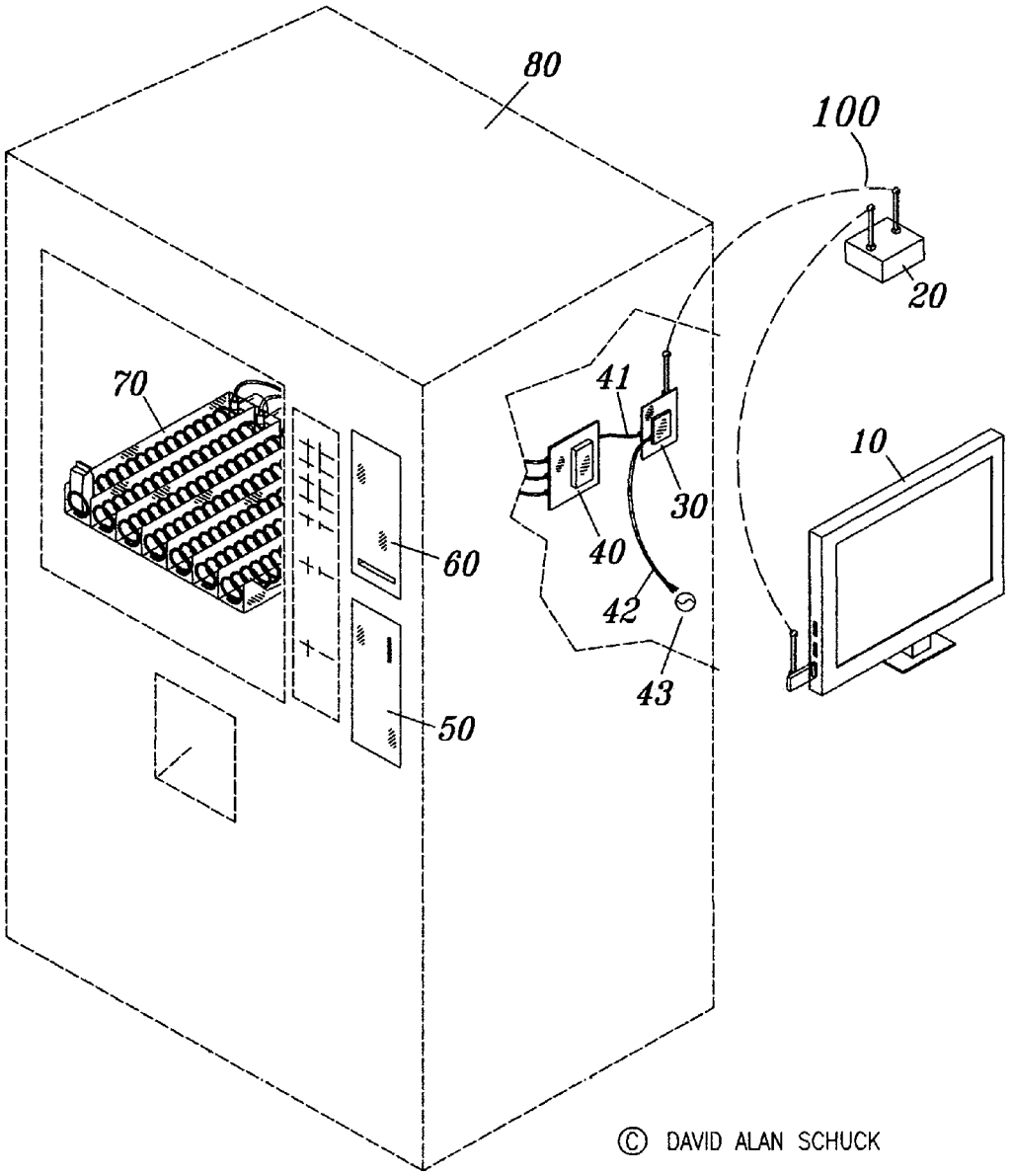
FIGS. 1, 2, 5, and 8 illustrate the preferred embodiment of the present invention, an apparatus for the remote sensing of vending machine contents.

Referring to FIGS. 1, 2, 5 and 8, the preferred embodiment of the present invention, a vending machine remote contents sensing apparatus 100 for a vending machine 80 comprises a product delivery drive 71, a product delivery feed 72, a product movement facilitator 81, a remote receiver 10 with web page with a web interface application program, a central processing unit (CPU) 30, a microcontroller unit (MCU) 40, a coin collector 50, a bill collector 60, and a product tray 70.

The coin collector 50 (Ref FIGS. 2 and 4) comprises a coin weight sensor 52, a light sensor 53, a coin track 54, and the coin collection container 56 for collecting coins 51.

The light sensor 53 senses each coin 51 from the coin track 54 into the coin collection container 56 for collecting coins 51. The information of the sensing of each coin 51 as it passes through the coin track 54 is communicated for further processing to count how many coins 51 have been sensed by the light sensor 53.

In the preferred embodiment of the present invention, as a coin 51 is collected by the coin collection container 56, the coin weight sensor 52 senses the weight of the coins 51 in the coin collection container. Information gathered by the weight sensor 52 is transmitted from the weight sensor 52 for processing.

The processing of the weight information permits determination of coin information, such as but not restricted to, total coins 51 weight, number of coins 51 collected by tallying each instance of a change in weight of the total coins 51 weight as each additional coin 51 is added, and each coin 51 face value from the change in weight of the total collection of coins 51, as different coins have different weights, which permits at least an approximate tally of the value of the coins 51 collected in the coin collection container 56.

An alternative to the aforementioned determination of a coin 51 face value would be to estimate from the total number of coins 51 collected using historical data of what the typical mix of face value of coins 51 collected in previous collections of coins 51 collected.

Information from the coin weight sensor 52 and the light sensor 53 is communicated to the MCU 40 through wiring 41. The MCU 40 transforms the information into a usable format. The information in the usable format is passed on to the CPU 30, then to the internet then to the remote receiver 10 equipped with the web page with the web interface application program which computes the at least approximate value of coins 51 collected, which is adequate information for determining when collection of the coins 51 is worth the time and expense of a service call.

Figure 2:
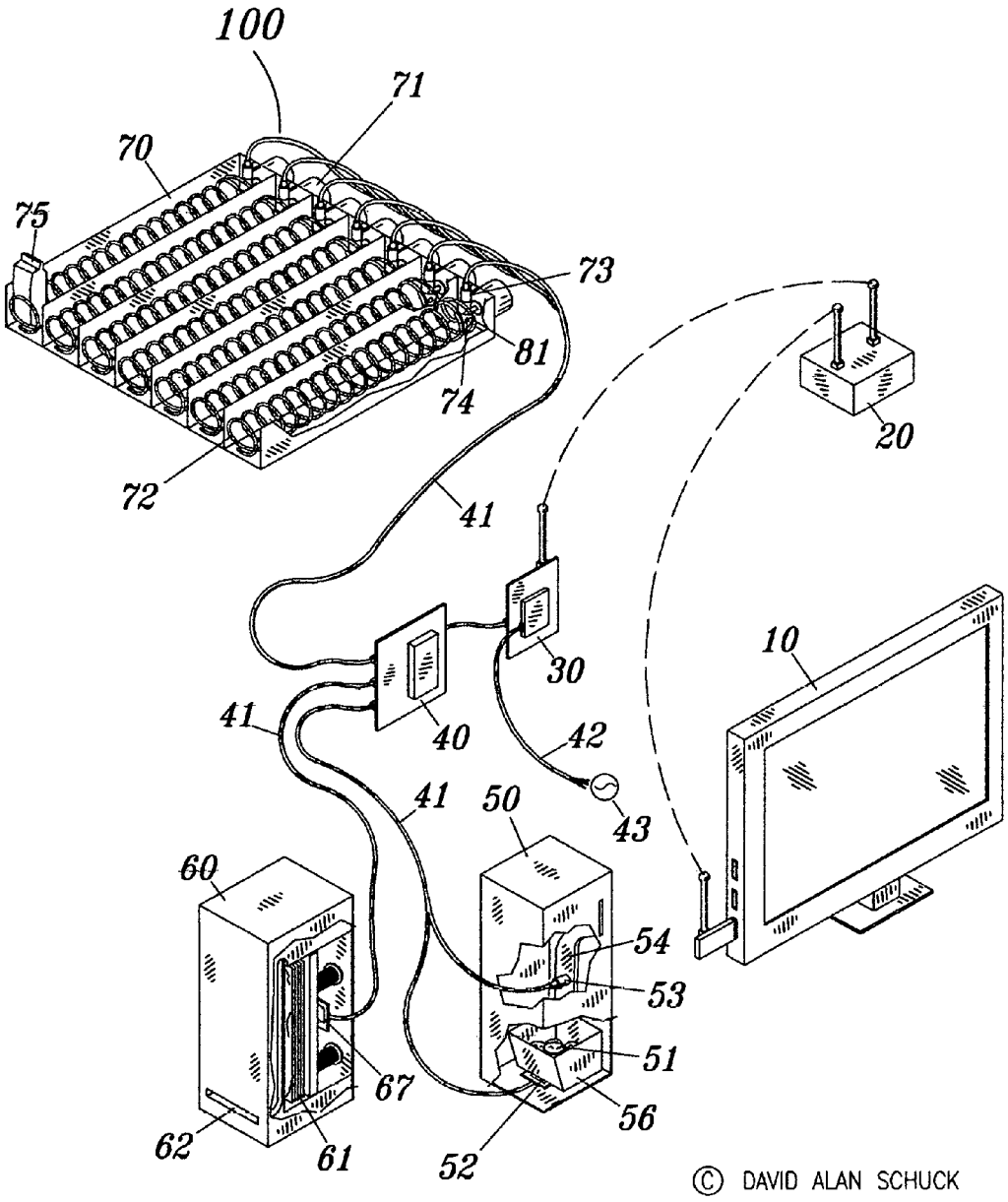
Figure 4:
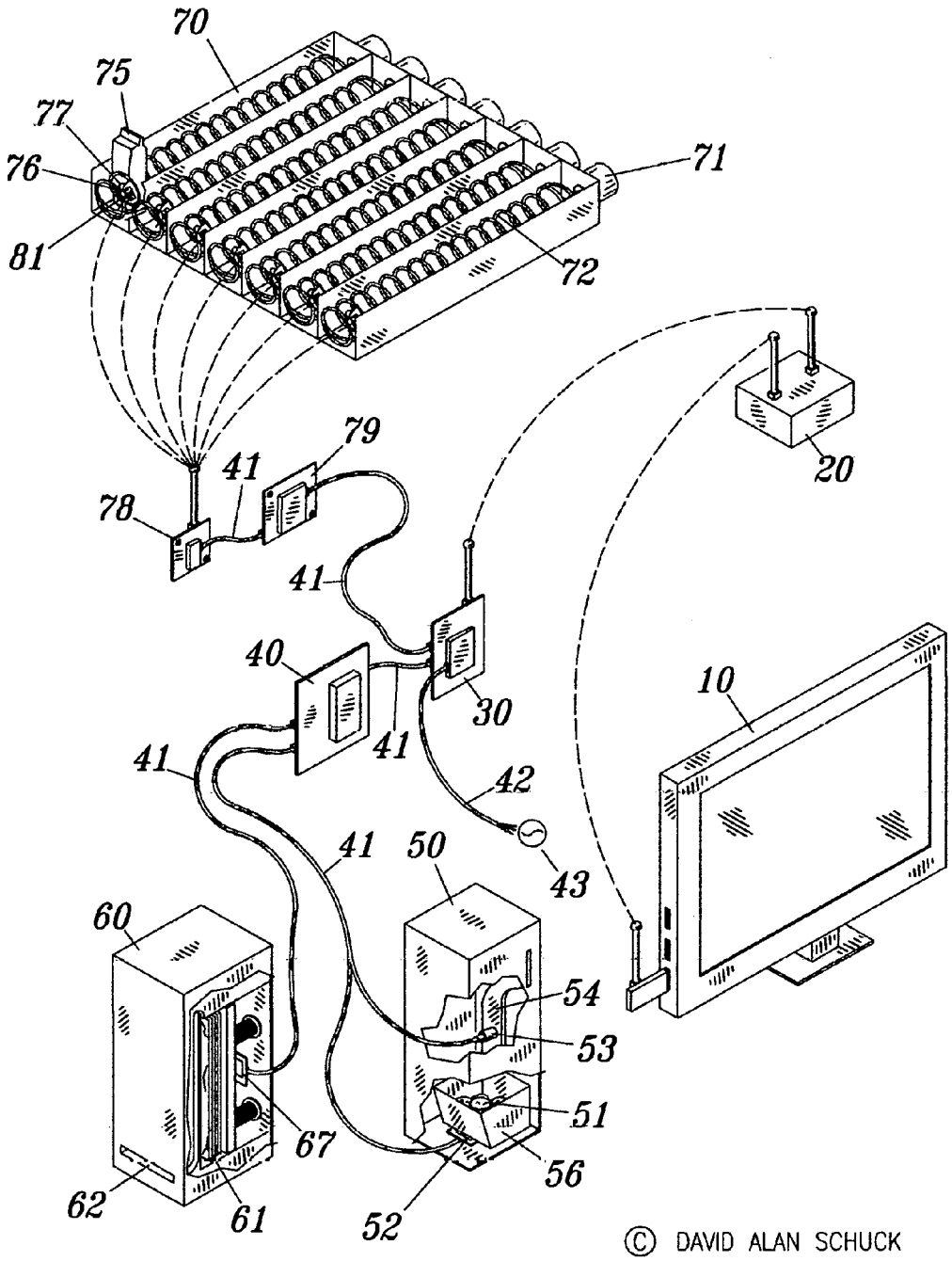
Figure 5:
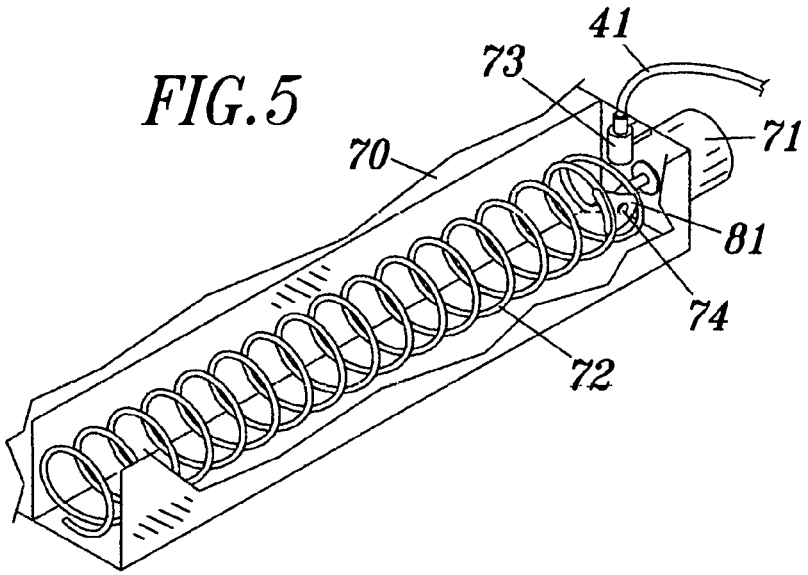
Figure 6:
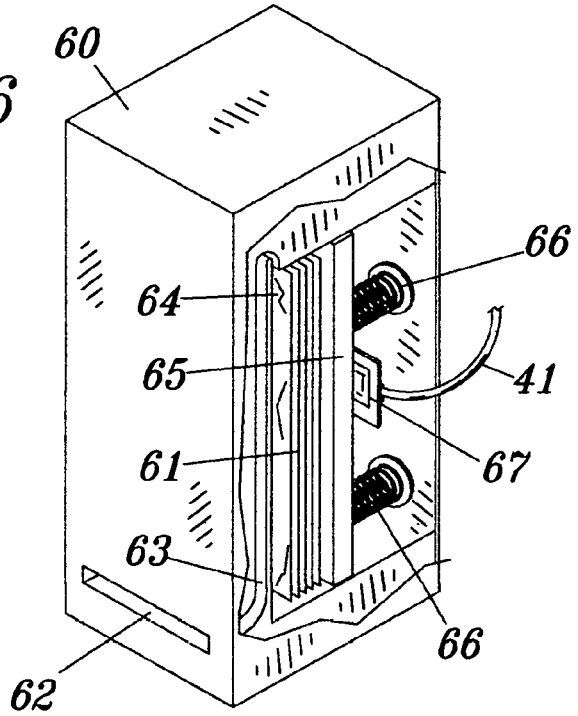
Figure 7:
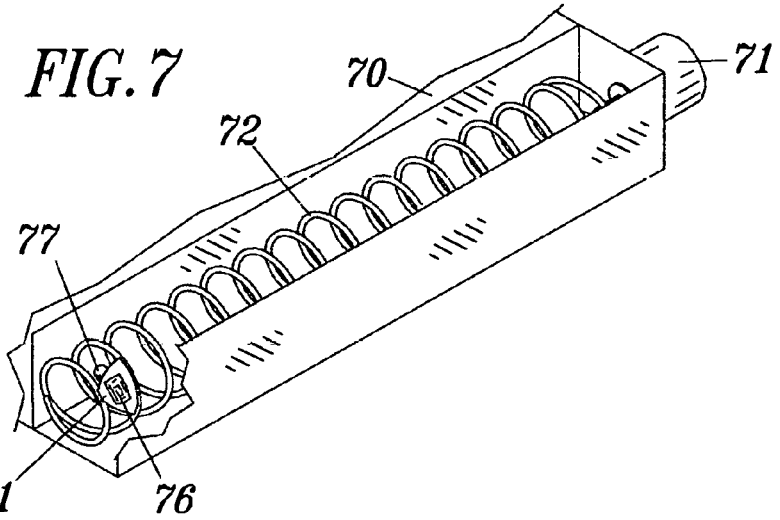

Referring to FIGS. 2, 4, and 6, the bill collector 60 comprises a bill reception slot 62, a channel 63, a storage area 64, a floating plate 65, springs 66, and a proximity sensor 67 for sensing how many money bills 61 have been collected.

When a money bill 61 is inserted into the bill reception slot 62, said bill 61 is passed through the channel 63 into the storage area 64.

The floating plate 65 is spring biased against bills 61 collected by the at least one spring 66.

The proximity sensor 67, in the preferred embodiment of the present invention, is a photoelectric cell proximity light sensor 67.

As the floating plate 65 is displaced by the bill 61 passing into the storage area 64, the proximity sensor 67 counts each money bill 61 as received into the storage area 64 and also judges the floating plate 65 displacement which permits an approximation of the value of the bills 61 based on accumulated averages of said bills 61 denomination obtained from previous bills 61 collections. The floating plate 65 displacement from the proximity sensor 67 is communicated by wiring 41 to the MCU 40 wherein the MCU receives information, such as, but not restricted to, the number of bills 61 collected as well as the storage area 64 capacity available. The MCU 40 also converts the information received into a usable format which is then transmitted to the CPU 30 which passes on the information in the usable format to the internet where it can be accessed on the aforementioned web page with the web interface application program by a service man by means of the remote receiver 10. The remote receiver 10 with the web interface application calculates and transforms the information received such as, but not restricted to, number of bills 61 collected, approximate value of bills 61 collected based on bill 61 denomination mixes from past collections, and remaining storage area 64 capacity for storing more bills 61.

Knowing the number of bills 61 received and also the approximate value of the bills 61 in the storage area 64 is of value for knowing when the time and expense of a service call to collect the bills 61 is worthwhile.

The product tray 70 comprises at least one product delivery drive 71, at least one product delivery feed 72, and at least one product movement facilitator 81.

In the preferred embodiment of the present invention, the at least one product delivery drive 71 is a rotary electric motor.

The CPU 30 is powered by a power source 43 through a power source wire 42.

In the preferred embodiment of the present invention, the switch 73 is a reed switch mounted to the product tray 70 (Ref. FIG. 2) when wiring 41 is used to communicate information from the switch 73 to the MCU 40.

A magnet 74 is affixed to the product movement facilitator 81 (Ref FIG. 2).

The switch 73 is actuated into a passing (i.e. closed) mode by the magnet 74, affixed to the product movement facilitator 81, which is attached to the product delivery feed 72. When the product delivery drive 71 rotates, a product 75 is delivered by the product delivery feed 72 and the product delivery feed 72, information in the form of an electrical signal passes on, through wiring 41 to the MCU 40, which transforms the information into a usable format to the CPU 30. The information in the usable format, that the product 75, is being delivered can then sent to the internet service provider (ISP) 20 which transmits the information is to the remote receiver 10 with a web page with a web interface application. The web page with the web interface application calculates for access by a service person in a readable form, information such as, but not restricted to, what product 75 from which product delivery feed 72, and how much product 75 remains in the given product delivery feed 72. This is real time information on actual product 75 delivery. This is different from current art that does not record actual delivery that may not happen in the event of a malfunction in the product delivery feed 72. The information in the CPU 30 can also be accessed directly, by a service man with a computer, such as, but not restricted to, a lap top computer.

Referring to FIGS. 3, 4, 7, and 8, a tilt switch 77 and an RFID tag 76 is attached to the product movement facilitator 81.

In this case, for purposes of enablement, the RFID tag 76 is modified by clipping a wire so as to have a gap in the RFID tag 76 internal circuit. This makes the modified RFID tag 76 unreadable until the gap created by clipping the wire in the RFID tag 76 internal circuit is bridged.

Said gap is bridged with the tilt switch 77 that has two electrical wires that are connected, one to each side of the gap when the tilt switch 77 is tilted, and passes into a closed (i.e. passing) condition.

When the product delivery drive 71 is rotated, the product delivery feed 72 is rotated, the product movement facilitator 81 with the tilt switch 77 mounted on the product delivery feed 72 is rotated. The tilt switch 77, which, in the preferred embodiment is a mechanical tilt switch 77 with two exterior wires and an internal ball (not shown). When the tilt switch 77 is tilted, the tilt switch 77 internal ball bridges the gap in the modified RFID tag 76 internal circuit, providing a communication link within the RFID tag 76 internal circuit.

The, RFID antenna 78 broadcasts a UHF signal to the RFID tag 76, when the tilt switch 77 tilts and the tilt switch 77 ball has provided the communication link within the RFID tag internal circuit, said UHF signal energizes the RFID tag 76 which results in the RFID antenna 78 receiving information from the RFID tag 76 affixed to the product movement facilitator 81. An RFID tag reader 79, connected to the receiving antenna 78 reads the information from the receiving antenna 78.

The aforesaid information from the RFID tag reader 79 is passed on, by wiring 41 directly to the CPU 30 which passes the RFID tag 76 information to the internet where it is available to the remote receiver 10 on the web page with the web interface application, providing, readable information such as, but not restricted to, on actual product 75 delivery from a specific product delivery feed 72, and remaining products 75 in the given product delivery feed 72, for access by a service person.

Figure 3:
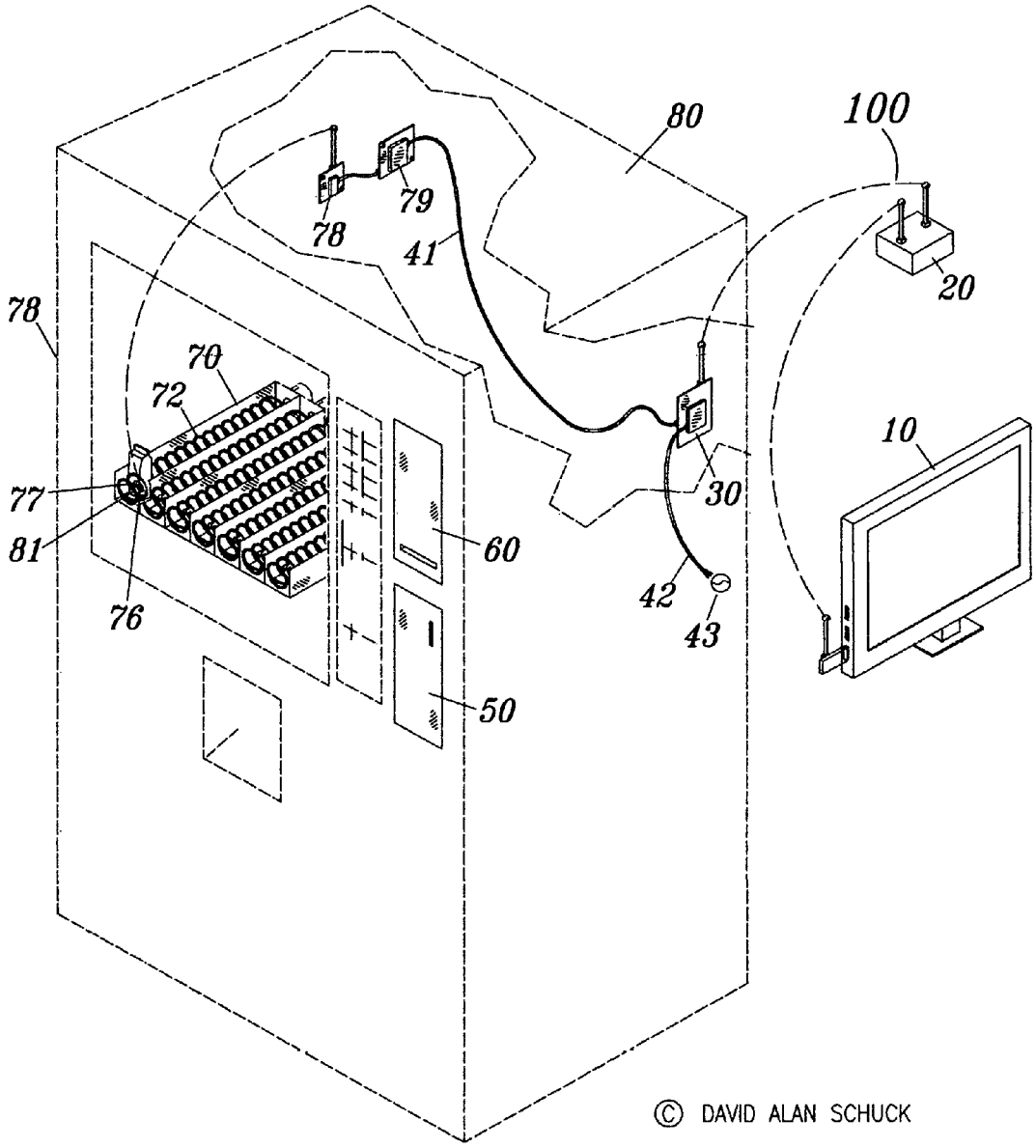
FIGS. 3, 4, 6, and 7, illustrate details of the alternate embodiment of the present invention.
Figure 8:
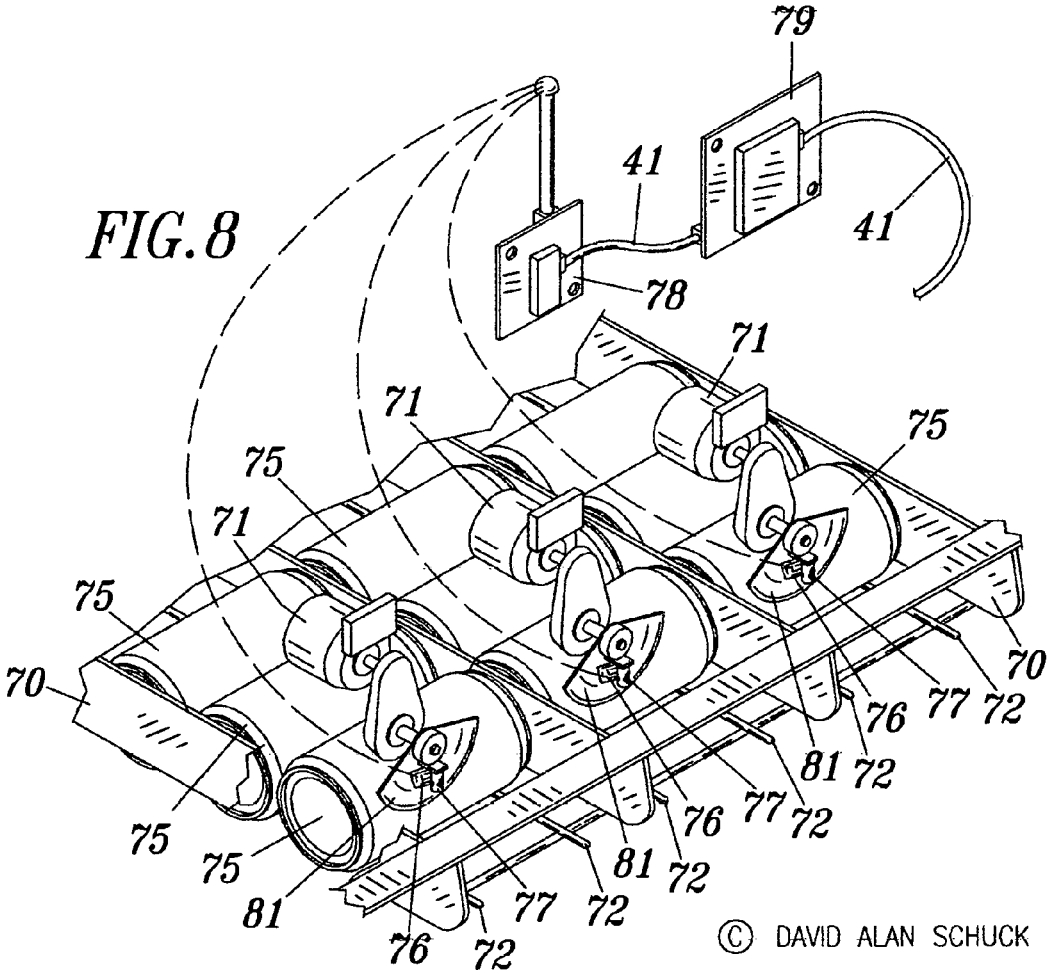

The CPU 30 is not shown on FIG. 8, only wiring 41 which is connected to the CPU 30 (Ref. FIGS. 3 and 4) which transmits to the internet.

For purposes of enablement, an ISP router 20 is indicated in FIGS. 1 through 4 as an example of the internet. However DSL, not illustrated, is an acceptable alternative to the ISP router 20.

In some cases, the product movement facilitator 81 that is used is known in the vending machine trade as a Universal Product Pusher and is commercially available. As obvious to anyone skilled in the art, a product movement facilitator 81 other than a Universal Product Pusher may be used.

When a product 75 comprises the RFID tag 76, the RFID antenna 78 passes on the RFID tag 76 information received to the RFID tag reader 79 which sends the RFID 76 tag information directly to the CPU 30 which passes it on to the internet. The RFID tag 76 information is then available from the internet to the remote receiver 10 with the web page with the web interface application program which can be accessed by a service person who can read the information transformed by the web interface application program into a readable form on real time actual product 75 delivery information.

When the product 75 has the RFID tag 76, there is no tilt switch 77 or RFID tag 76 on the product movement facilitator 81.

Also, when the product 75 has the RFID tag 76, the RFID antenna 78 is located within the vending machine 80 near the product 75 with the RFID 76 tag being purchased, during the delivery of the product 75 with the RFID tag 76, so as to read only the RFID tag 76 on the product 75 being purchased, as opposed to the RFID antenna 78 reading all the products 75 with RFID tags 76 in the vending machine 80.

The use of the tilt switch 77 and the modification discussed on the modified RFID tag 76 serve a similar purpose, namely to only read what is being purchased, not RFID tags 76 on other products 75 with RFID tags in a vending machine 80.

In FIGS. 1-7, in the preferred embodiment of the present invention, the product delivery feed 72 is a helical coil.

In FIG. 8, the product delivery feed 72 is an inclined channel which permits product 75, which is cylindrically shaped in FIG. 8 to roll into the position for release by the product movement facilitator 81.

Each of the product delivery feeds 72 have a product movement facilitator 81, to facilitate final delivery of the product 75 selected by a buyer.

In operation, referring to FIGS. 1 and 2, a customer deposits his/her coin 51 or money bill 61 and selects a product. A selected product delivery drive 71 rotates product movement facilitator 81 facilitates the delivery the selected product 75 from a given product delivery feed 72 to the customer. An adjacent product 75 is moved into position by the product delivery feed 72 to replace the delivered product 75.

As this transaction is taking place, the magnet 73 is rotated past the switch 74, actuating the switch 74 into a passing mode, so an electric signal is transmitted along wiring 41 to the MCU 40. The MCU 40 transforms the electric signal into a usable format and passes it on the CPU 30 which broadcasts the usable format to the internet, where it is available to a service person, on the remote receiver 10 with the web page with the web interface application program.

The web page with the web interface application program computes from the usable format of information from the CPU 30 through the internet information such as, but not restricted to, that a given product 75 has been dispensed from a specific product delivery feed 72 with the date and time. This information is available in a readable form for access by the service person.

If the something happens where the product 75 is not delivered as expected, there will be no count of a product delivery. This is a major advantage over current art where there could be a count of a product delivery that didn't happen, as previously mentioned in the background information discussion.

The apparatus 100 can be fitted to as many product delivery feeds 72 as needed for inventory. The remote receiver 10 with the web page with the web interface application program tracks from the usable format of information received, which product 75 was delivered from which product delivery feed 72, at what date and time, and how much product 75 is remaining in a given delivery feed 72, and which products 75 in which delivery feeds 72 are the slow moving and out of date products 75.

Information on the accumulated number of each specific product 75 units sold, and approximate totals coins 51 and money bills 61 received from the accumulated sales, as the sales occur is gathered by the MCU 40, changed into a usable format, then transmitted to the CPU 30 which forwards the information in the usable format to the internet where it is available to the remote receiver 10 with web page with the web interface application where the information in the usable format is processed by the web page with the web interface application program so it is accessible on said web page in a readable format to vending machine service personnel.

The apparatus 100 permits a vending machine service person can check inventory status and cash without needing to visit a vending machine. For the applicant, who has a number of vending machines, this saves him approximately two thirds of his time attending to his machines.

On many vending machines, especially older machines, this is currently a manual process which takes maybe 20 or 30 minutes. This manual process is replaced by the preferred embodiment of the present invention.

Although the description above contains many specificities, these should not be construed as limiting the scope of the invention, but as merely providing illustrations of some of the preferred embodiments of the present invention.

As an example, the tilt switch 73 is described as a mechanical tilt switch wherein a ball bridges a communication gap within the RFID tag 76 pieces during the rotation of the product delivery facilitator 81. However, as obvious to anyone skilled in the art, a mercury tilt switch would also function as well, as would an electronic switch as technology develops.

The internet is represented by the prior art ISP router 20 disclosed and illustrated for enablement purposes. Prior art DSL (not illustrated) is an alternative to the ISP router 20.

It will be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A remote sensing system for sensing vending machine content comprising:

a) a central processing unit (CPU)

b) a microcontroller (MPU)

c) a product tray d) at least one product delivery drive e) at least one product delivery feed f) at least one product delivery facilitator g) at least one switch, and h) at least one magnet wherein said at least one switch is mounted on said product tray, wherein said at least one magnet is attached to said at least one product movement facilitator, wherein when a customer purchases a product in said product tray, said at least one product delivery drive rotates said at least one product movement facilitator attached to the product delivery feed and rotates said at least one product delivery feed to deliver the product from said product tray, wherein when said at least one product movement facilitator is rotated, said at least one magnet on said at least one product movement facilitator is rotated past said at least one switch on said product tray, wherein when said at least one magnet is rotated past said at least one switch, said at least one switch is activated into a passing mode such that an electrical signal passes from the product delivery feed to said MCU, the electrical signal signifying a delivery of the product, wherein said MCU transforms said electrical signal into information in a usable format and passes said information in the usable format to said CPU.

2. The remote sensing system of vending machine contents of claim 1 further comprising an internet service provider (ISP) wherein the CPU transmits the information in the usable format to the internet service provider, wherein the transmitted information in the usable format is available to a remote receiver with a web page with a web page interface application program, wherein the web page with the web interface application program has the information in the usable format transforms the information in the usable format into information that can be accessed and read by a serviced person, and wherein the information that can be accessed by a service person is real time readable information on the product actually delivered.

3. The remote sensing system for sensing vending machine content of claim 2 further comprises a coin collector comprising:

a) weight sensor, b) a coin track, and c) a coin collection container, wherein said weight sensor weighs coins in said coin collection container, wherein information of a weight and number of said coins in said coin collection container is transmitted to said MCU, wherein said MCU transforms said information of the weight and number of said coins into a usable format and passes said information in said usable form to said CPU, wherein said CPU passes said information in said usable format on to the Internet, wherein a service person can access said information in said usable format in a readable form on said webpage with said web interface application program in said remote receiver with said web interface application for an approximate value of coins received.

4. The remote sensing system for sensing vending machine content of claim 1 wherein the information contained in the CPU can be accessed by a service person with a computer.

5. The remote sensing system for sensing vending machine content of claim 1, further comprise a money bill collector comprising:

a) a bill reception slot, b) a channel, c) a storage area, d) a floating plate, e) at least one spring, a proximity sensor, wherein when a plurality of money bills are inserted into said bill reception slot, each of said money bills is passed through said channel, into said storage area, against said floating plate, wherein said floating plate is biased against said money bills as they accumulate by said at least one spring, wherein said proximity sensor counts each said money bill as received and also senses a distance from said proximity sensor to said floating plate for evaluation of remaining capacity in said storage area for storage of additional said money bill storage which permits calculation of an approximate value of the money bills collected and communicates with said MCU which transforms the information from said proximity sensor into a usable format and passes said usable format of said information to the CPU which passes said usable format of said information to the Internet where the information in the usable format can be pulled up on a web page with a web interface application program of a remote receiver, in a readable form by a service person for evaluation of when to pick up said money bills collected.

* * * * *